United States Patent [19]

Fessler

[11] 4,174,872

[45] Nov. 20, 1979

[54] BEVERAGE DISPENSING MACHINE AND CABINET THEREFOR

[75] Inventor: Herman S. Fessler, Coon Rapids, Minn.

[73] Assignee: The Cornelius Company, Anoka, Minn.

[21] Appl. No.: 895,096

[22] Filed: Apr. 10, 1978

[51] Int. Cl.[2] ..... A47B 81/00

[52] U.S. Cl. ..... 312/290; 312/257 R; 312/107; 222/129.1

[58] Field of Search ..... 312/257 R, 290, 291; 222/129.1, 129.2, 129.3, 129.4; 221/96

[56] References Cited

U.S. PATENT DOCUMENTS

| | | | |
|---|---|---|---|
| 776,042 | 11/1904 | Acheson | 312/107 |
| 3,012,835 | 12/1961 | Anderson et al. | 312/257 R |
| 3,019,946 | 2/1962 | Mueller | 222/129.1 |
| 3,133,427 | 5/1964 | Petkwitz | 312/290 |
| 3,327,902 | 6/1967 | Alterwitz | 222/129.1 |
| 3,836,220 | 9/1974 | Ishammar | 312/290 |
| 3,892,335 | 7/1975 | Schroeder | 222/129.1 |
| 3,995,922 | 12/1976 | Ohashi | 312/257 R |

*Primary Examiner*—Victor N. Sakran

*Attorney, Agent, or Firm*—Henry C. Kovar

[57] ABSTRACT

A beverage dispensing machine has an exterior cabinet and a beverage preparation and dispensing apparatus mounted within the cabinet; the cabinet has a base having a bottom, short side and rear panels of the same height, a cantilevered tall side panel and a structural cross member connecting the top of the short side panel to the tall side panel; a lockable cabinet door of the same height as the tall side panel is pivotally hinged to the tall side panel; a removable cabinet top cap is removably mounted on top of the base and has a top panel, tall and short side panels which are atop of the short and tall base side panels respectively, a front faceplate above the cabinet door and cup dispenser tubes projecting through the face plate; fasteners inside of the cabinet normally secure the top cap to the base and the fasteners are accessible when the door is opened for releasing the top cap from the base; the beverage dispensing apparatus is a module mounted to the cross member and is above the level of the base short side and rear panels and when the top cap is removed, the dispensing apparatus is directly accessible from the front, rear, side and top for service and/or replacement.

55 Claims, 14 Drawing Figures

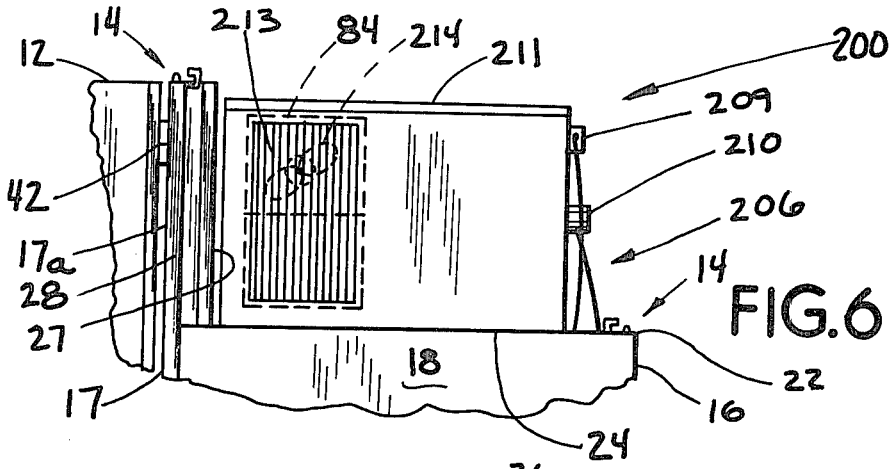
FIG.6
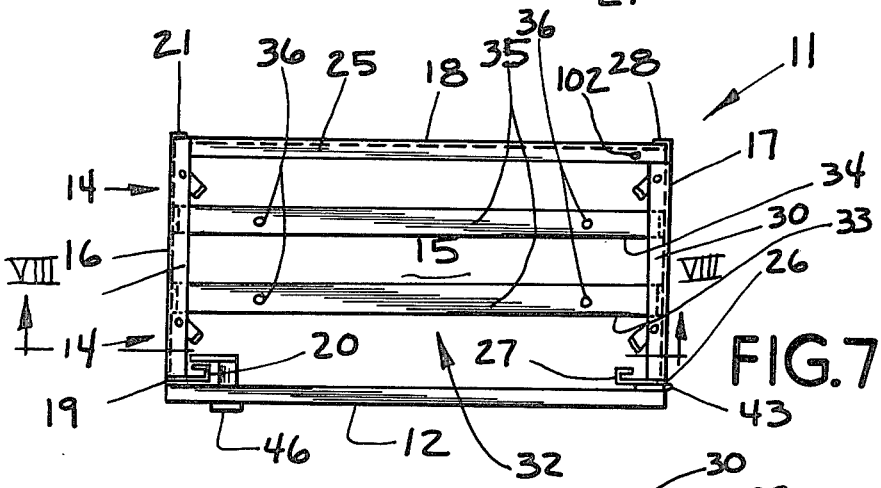
FIG.7
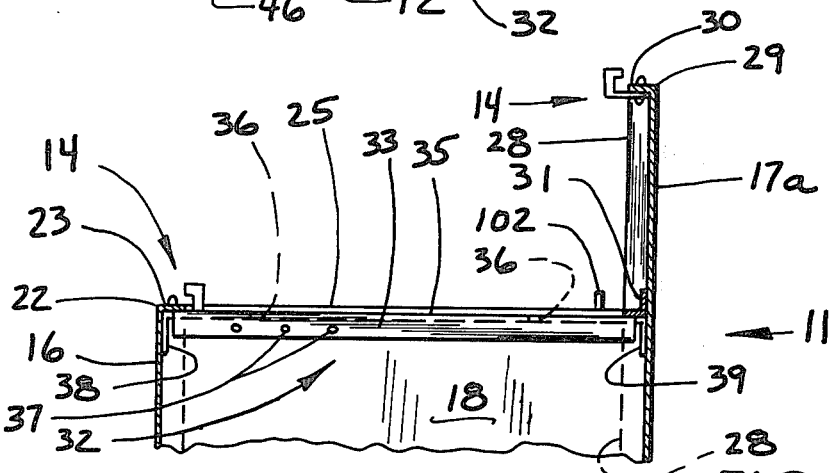
FIG.8
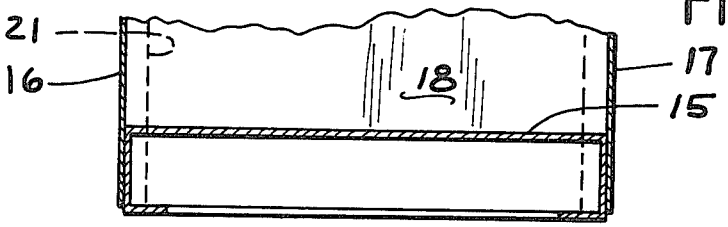

BEVERAGE DISPENSING MACHINE AND CABINET THEREFOR

BACKGROUND OF THE INVENTION

1. Field of the Invention

This invention pertains to a beverage dispensing machine having a cabinet with a removable top for providing access to a beverage preparation and dispensing apparatus, and to a cabinet structure for a beverage dispensing machine in which the cabinet has base, door, and top cap components with the top cap being removable from the rest of the cabinet.

2. The Prior Art

Prior beverage dispensing machines and the cabinets therefor have an upright cabinet box with bottom, side, top and rear panels, all of which are fastened together permanently. A lockable cabinet door is pivotally hinged to one of the side panels. Within the cabinet are mounted the various components needed for preparation and dispensing of beverage as well as coin receiving and electronic components for effecting beverage dispensing.

Beverage dispensing machines require continued servicing. Beverage ingredients, for example soft drink syrups, carbon dioxide gas, coffee, sugar, cremer, chocolate and the like, must be regularly replenished, and monies must be regularly removed. The owner of the machine normally provides a route person for this servicing of the machine.

However, a service man is usually required when the beverage machine breaks down and refrigeration ceases to operate, solenoid water or concentrate valves fail, controls malfunction or the dispensing apparatus malfunctions. The service man is much more expensive than the route person and the more complicated the dispensing machine, the more costly is the service man both in terms of time required and competence level which must be paid for. Service calls are most frustrating, expensive to owners of dispensing machines and irritating to the consuming public which depends upon the dispensing machine.

Prior beverage dispensing machines have usually had a one-piece box in which all dispensing components are mounted. Usually only the front door opened and the only access was from the front. Then each individual component had to be discretely inspected and serviced if necessary. Refrigeration systems have most recently been provided on slides for push-in/pull-out access. Components within the cabinet have been placed one behind the other and several components typically must be removed to gain access to rear mounted components. Doors opening in side panels have been provided but these doors require that the machine be pulled clear of adjacent structures or else be provided with open lateral space for the side door to open. Consequently, the previous dispensing machines have been costly to service.

Cabinet damage has been a problem with prior dispensing machines; if the cabinet incurred damage due to shipping, accident, vandalism, or other incident, replacement of the complete cabinet was necessary and this required complete and time consuming removal and reinstallation of all the operating components.

Prior dispensing machines using cup storage and dispensing tubes from which the public manually removed cups, typically had the cup tubes mounted on the outside of the machine or in an adjacent countertop.

In either example, the cup tubes were liable to become dirty and were not easily cleaned.

The prior beverage dispensing machines have had multiple unaccessible and uncleanable crevices in which beverage product would accrue, or else crevices and interior features difficult and time consuming to clean.

Excessive complication and lack of provision for serviceability exemplify the known prior dispensing machines.

No prior and relevant patents are known.

OBJECTS OF THE PRESENT INVENTION

It is an object of the present invention to provide a beverage dispensing machine having a removable top cap for provision of unobstructed access to dispensing apparatus within a cabinet of the machine.

It is an object of the present invention to provide a beverage dispensing machine of simplified construction for improved serviceability.

It is an object of the present invention to provide a beverage dispensing machine constructed of dispenser, cabinet base, cabinet door and cabinet top cab components, all of which are individually replaceable.

It is an object of the present invention to provide a beverage dispensing machine cabinet having a relatively shortened base, a relatively tall and full height front door, and a removable top cap.

It is an object of the present invention to provide a beverage machine cabinet of separable multiple components having structural integrity comparable to non-separable cabinets.

It is an object of the present invention to provide a beverage dispensing machine cabinet for enclosing and providing access to a beverage age dispensing module mountable within the cabinet.

Many other advantages, features and additional objects of the present invention will become apparent to those versed in the art upon making reference to the enabling detailed description and accompanying drawings in which the preferred embodiment incorporating the principles of the present invention is set forth and shown by way of illustrative example.

SUMMARY OF THE INVENTION

In accordance with the principles of this invention, a beverage dispensing machine has an upright cabinet base, a beverage dispensing apparatus mounted on the base and positioned at a level higher than a side of the base, a cabinet door hinged to the base, and a top cap removably secured to the base and enclosing the dispensing apparatus; the cabinet per se is a distinct aspect of the invention with the base having short and tall side panels and structure for supporting and positioning dispenser apparatus at a level higher than the top of the short side panel, and with the top cap having a side panel extending down from a top panel and adjoining the base short side panel.

ON THE DRAWINGS

FIG. 6 is a rear elevational view of the machine of FIG. 2 with the top cap removed;

FIG. 7 is a top view of the cabinet base of the structure of FIG. 1;

FIG. 8 is a front elevational sectional view of the base of FIG. 1, taken along section lines VIII—VIII of FIG. 7;

AS SHOWN ON THE DRAWINGS

Figure 1:
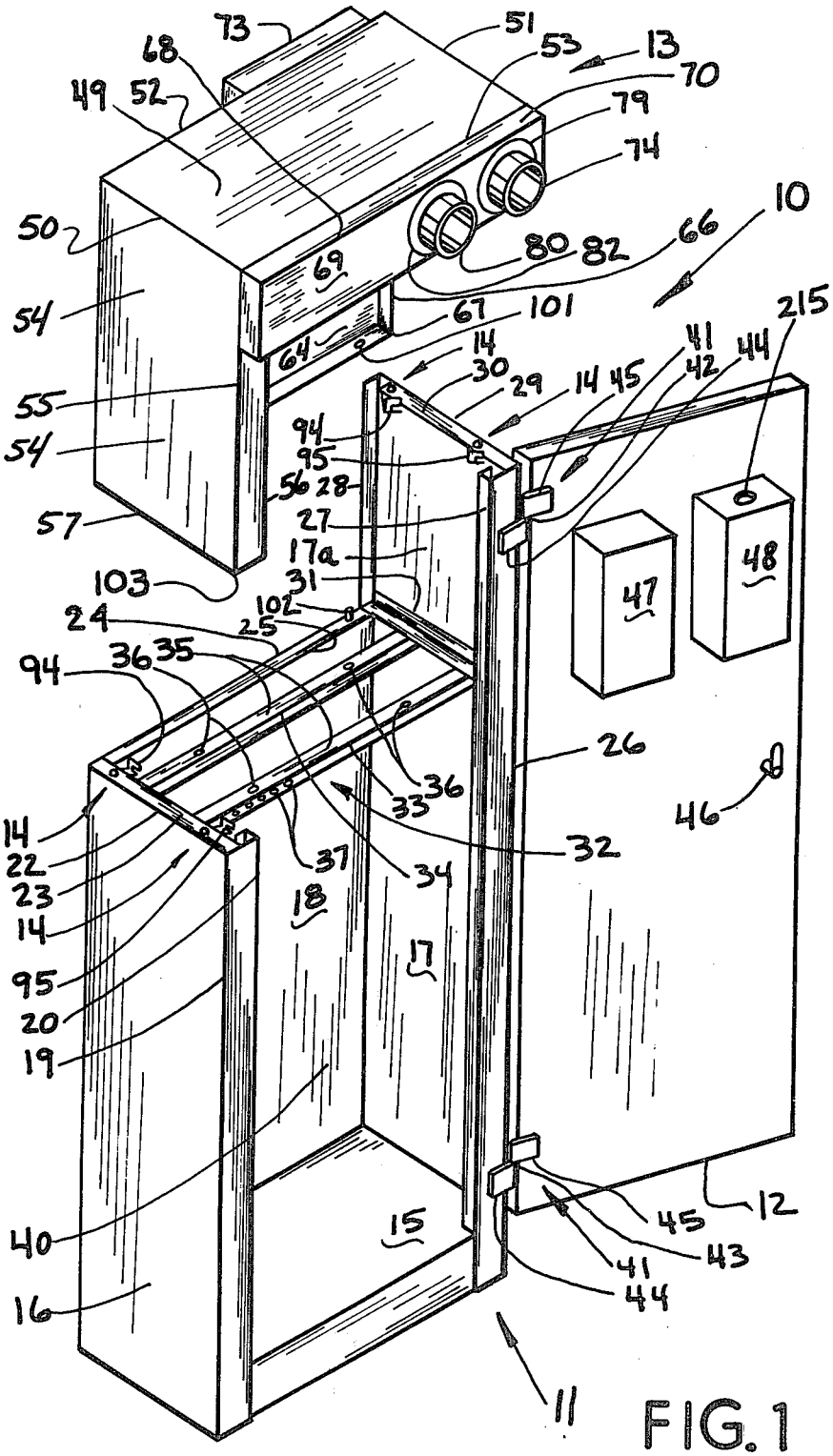
FIG. 1 is an exploded perspective view of a beverage dispensing machine cabinet provided in accordance with the principles of the present invention.

The principles of the present invention are particularly useful when embodied in a beverage dispensing machine cabinet of the type illustrated in FIG. 1 and generally indicated by the numeral 10.

The cabinet 10 includes a base 11, a door 12, a removable top cap 13 and fasteners 14 for securing the top cap 13 to the base 11. The cabinet 10 is specifically for and is a novel part of the beverage dispensing machine 200 in FIGS. 2 and 3.

The cabinet base 11 has a bottom 15, a pair of side panels 16, 17 attached to opposite sides of the bottom 15, and a rear panel 18 attached to rear of the bottom 15 and to the side panels 16, 17. One of the side panels, specifically side panel 16 is a short side panel, and the other of the side panels, specifically side panel 17 is a tall side panel. The tall side panel has a greter height than does the short side panel 16. The short side panel 16 has a front edge 19 and depending therefrom is an upright and continuous front structural stiffener flange 20. A short side panel rear structural flange 21 joins the short side panel 16 to the rear panel 18. The short side panel has a top edge 22 and depending therefrom is a top flange 23 extending inwardly into the cabinet 10. The rear panel 18 has a top edge 24 and depending therefrom is a top flange 25 extending forward and inwardly into the cabinet 10. The tall side panel 17 is considerably higher than the short side panel 16 and has a front edge 26 from which depends an upright and continuous front structural stiffener flange 27 extending the entire height of the tall side panel 17. The tall side panel 17 also has a rear structural flange 28 extending the entire height of the tall side panel 17 and joining the tall side panel 17 to the rear panel 18. The tall side panel 17 has a top edge 29 and depending therefrom is a top flange 30 which extends inwardly into the cabinet 10. The tall side panel 17 also has a structural flange 31 which extends from the rear to the front of the tall side panel 17; this structural flange 31 is below the top flange 30 and well above the bottom 15. Specifically, the structural flange 31 is at the same height level as is the short side panel top flange 23 and the rear panel top flange 25. These three flanges 23, 25, 31 lie in a common horizontal plane. A structural cross-member generally indicated by 32 fastens the side panels 16, 17 to each other. The cross-member 32 has a pair of discrete structural members; a front structural member 33 is nearest but spaced from the door 12 and there is a rear structural member 34 spaced from the front member 33 and nearest to but spaced from the rear panel 18. Both of the front and rear structural members 33, 34 have an upward facing support surface 35 upon which a beverage dispensing apparatus can be mounted, the structural members 33, 34 have fastener apertures 36 for securement of a beverage dispensing apparatus to the structural members 33, 34, and various fastener apertures 37 for securement of such things as fluid flow rate controls and gas pressure regulators. At each end of the structural members 33, 34 there are flanges 38, 39 which are spotwelded to the side panels 16, 17 respectively. The structural members 33, 34 are abutted against the short side panel top flange 23 and the tall side panel structural flange 31 and are also welded to these flanges 23. 31. The support surfaces 35 are then substantially at the same height level as the short side panel top flange 23 and rear panel top flange 25 and the tall side panel structural flange 31 and are co-planar therewith. The structural cross-member 32 is spaced substantially above the bottom 15 and there is provided therebetween a storage compartment 40 for storage of beverage supplies such as syrup, carbon dioxide, and water vessels.

The cabinet door 12 is pivotally secured to the front edge 26 of the tall side panel 17 by a vertical axis hinge 41. The hinge 41 is mounted to the tall side panel 17 and door 12 so that the effective height of the hinge extends higher than the height level of the short side panel 16, and the door 12 is taller than the short side panel 16 and preferably is of the same height as the tall side panel 17. The door hinge 41 is divided into a separate top hinge joint 42 and bottom hinge joint 43. The bottom hinge joint 43 is mounted adjacent to the bottom of the door 12 and the base bottom 15. The top hinge joint 42 is mounted adjacent to the top of the cabinet door 12 and at a level substantially above the highest level of the base short side panel 16 and above the tall side panel structural flange 31. Each of the hinge joints 42, 43 have an inner leaf 44 fixedly secured to the structural front stiffener flange 27 of the tall side panel 17, and an outer leaf 45 secured to the cabinet door 12. The inner leaves 44 preferably each have an upward extending cantilevered pin (not shown) and the outer leaves have a complimentary internal journal (not shown) and the door 12 may be raised to disengage the hinges 41 and remove the door 12 from the base 11. The top portion 17*a* of the tall side panel 17 which is higher than the short side panel 16 extends upwardly as a cantilever and is braced by both of the rear flange 28 and the front flange 27 which also supports the top hinge joint 42 which is also cantilevered. The cabinet door 12 is shown in an open position in FIG. 1 and the door 12 pivots inwardly about the hinge 41 until it abuts against the short side panel front stiffener flange 20. The door 12 has a lock 46 which hooks behind the flange 20 and locks the door 12 closed. The door 12 serves as a mount and support for a box 47 for housing coin equipment and vend selection electrical apparatus and a box 48 for a dispensing station into which a cup is placeable and into which beverage will be dispensed.

The removable cabinet top cap 13 is an important feature in the present invention and is shown in FIG. 1 and in more detail in FIGS. 9–12. The top cap 13 has a top panel 49 having a first side edge 50, a second side edge 51, a rear edge 52 and a front edge 53. A side panel 54 extends downwardly from the first side edge 50 and this side panel 54 has a front edge 55 from which depends a structural stiffener flange 56 of the same type as the flange 20 on the base short side panel 16. The top cap side panel 54 also has a bottom edge 57 and a bottom flange 58 depending therefrom and extending into the cabinet 10. A second side panel 59 extends downwardly from the second side edge 51 of the top panel 49. The second side panel 59 has a front edge 60 having a stiffener flange 61 of the same type as the stiffener flange 27 of the base tall side panel 17. The top cap second side panel 59 also has a bottom edge 62 from which depends a bottom flange 63 which extends inwardly into the cabinet 10. A rectangular rear panel 64 extends downwardly from the top panel rear edge 52 and has a bottom edge from which depends a bottom flange 65 which extends forward into the cabinet 10. The top cap rear panel 64 also has a side flange 66 extending down from the top panel second side edge 51, and a distal corner 67.

On the front of the top cap 13, there is a face plate 68 having a front surface 69, a top surface 70, a bottom surface 71 and a bottom flange 72 which backs up the cabinet door 12. The face plate 68 is attached to the top cap side panels 54, 59 and the top cap top panel 49, and structural ties these panels 49, 54, 59 together making them a rigid structure.

At the rear of the top cap 13 and in the top cap rear panel 64, there is mounted a hollow stand-off 73 which projects to the rear of the cabinet 10. The stand-off 73 is open to the inside of the cabinet 10 and precludes placement of the cabinet rear surface snug against a wall.

A cup storage and dispensing tube 74 is mounted within the top cap 13. The cup tube 74 has a closed end 75 mounted within the stand-off 73 and secured by a clamp 76. The cup tube 74 has an open end 77 extending externally of the top cap 13 through an aperture 78 in the face plate 68. The cup tube 74 is spaced from the aperture 78 by a non-metallic grommet 79, specifically a rubber grommet. There is also provided a second cup tube 80 extending through a second aperture 81 and having a second grommet 82. The cup tubes 74, 80 are parallel to each other and are both mounted parallel to the top panel 49 and the tube open ends 77, 83 are supported by the face plate 68. The cup tubes 74, 80 are both on one side of the top cap 13 and the stand-off 73 extends only partially across the rear panel 64 of the top cap 13. Directly underneath the stand-off 73 there is an air passageway 84 defined by an aperture 85 in the rear panel 64, the air passageway 84 is further defined by an air box 86 surrounding the aperture 85 and having a baffle 87 dividing the passageway 84 into an air inlet 88 and an air outlet 89, both of which are covered by a screen 90 and which are surrounded by a resilient gasket 90*a*.

Figure 2:
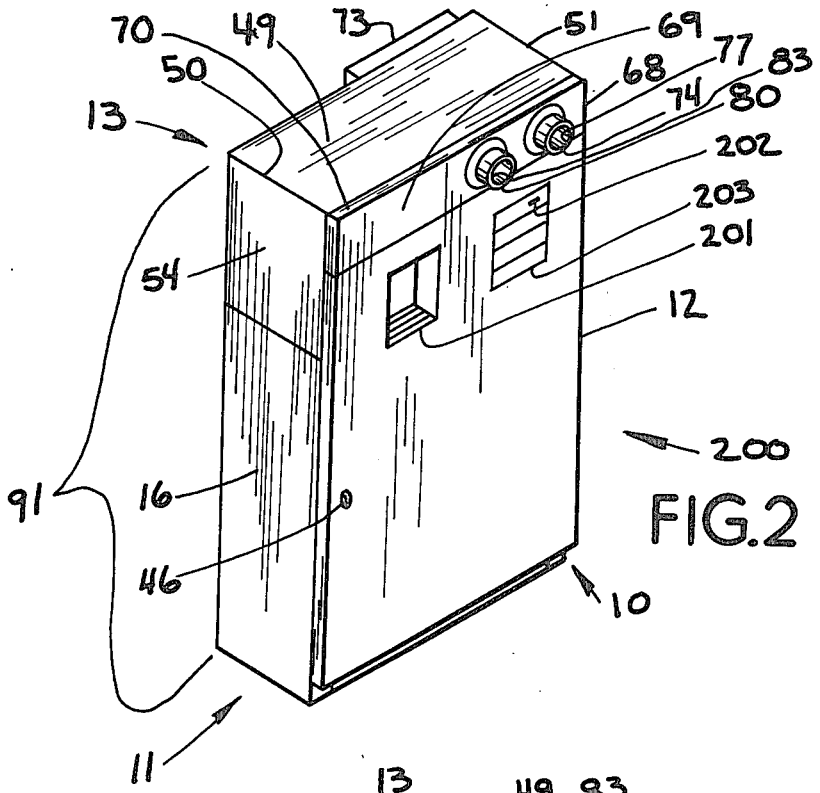
FIG. 2 is a perspective view of a beverage dispensing machine provided in accordance with the principles of the present invention and utilizing the cabinet of FIG. 1.
Figure 3:
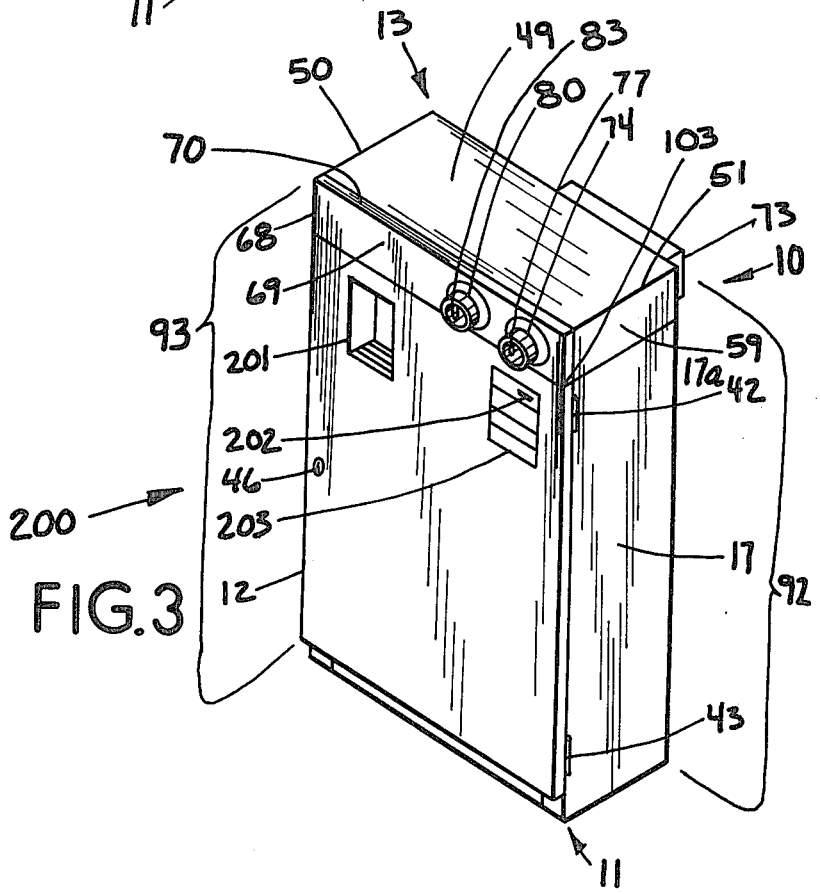
FIG. 3 is a perspective view of the machine of FIG. 2, from the other side.

The top cap 13 normally sits on top of the base 11 and the top cap 13 and base 11 together form a complete box for the cabinet 10 as is shown in FIGS. 2 and 3. The top cap first side panel 54 is the taller of the top cap side panels 54, 59 and it sits atop of and is connected to the base short side panel 16 forming a complete side 91 of the cabinet 10. The second top cap side panel 59 is the shorter of the top cap side panels 54, 59 and it sits atop of and is connected to the base tall side panel 17 forming a second complete side 92 of the cabinet 10. The top cap rear panel 64 is substantially the same height as the top cap tall side panel 54 and the cap rear panel 64 sits atop of the base rear panel 18 forming a complete rear side (not shown) of the cabinet 10. The top cap face plate 68 is substantially the same height as is top cap short side panel 59 when measured downward from the top panel 49, and the face plate 68 is above the cabinet door 12 which is substantially the same height as is the base tall side panel 17. The cabinet door 12 and face plate 68 together form a front side 93 of the cabinet 10 which is of the same height as the complete sides 91, 92. With the complete sides 91, 92, 93 all being of the same height, the top panel 49 is parallel to the base bottom 15.

The removable cabinet top cap 13 is normally secured to the base 11 by the fasteners 14 which are accessible only from inside of the cabinet 10 when the door 12 is open. The fasteners 14 are mounted on the base side panel top flanges 23, 30 and fasten the top cap bottom flanges 58, 63 to these base side panel flanges 23, 30. The flanges 23, 30 each extend from the rear to the front of the base side panels 16, 17 respectively and serve to stiffen the respective side panel top edges 22, 29. The rear panel top flange 25 extends across the width of the rear panel 18 and serves to stiffen the rear panel top edge 24. The base tall side panel top flange 30 is the mirror image of the base short side panel top flange 23 and is the structural equivalent thereof. The top cap fasteners 14 include two individual fasteners on each base side panel top flange; there is a rear fastener 94 and a front fastener 95 on each of the top flanges 23, 30. The rear fasteners 94 are positioned between the base rear panel 18 and the structural cross member 32 and are accessible from the storage space 40; and the front fasteners 95 are positioned between the structural cross member 32 and the front edge stiffener flanges 20, 27.

Figure 13:
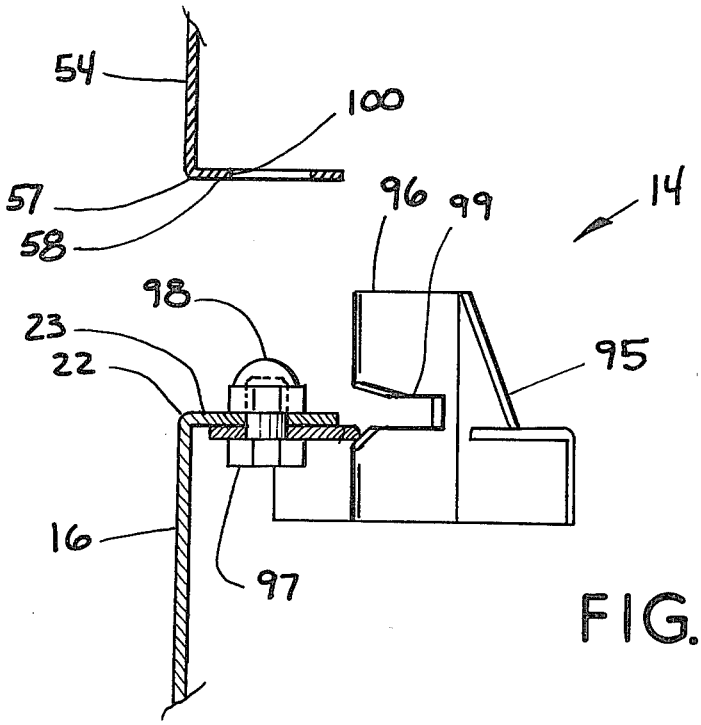
FIG. 13 is a detailed elevational partial section showing a fastener for securing the structure of FIG. 1 together.
Figure 14:
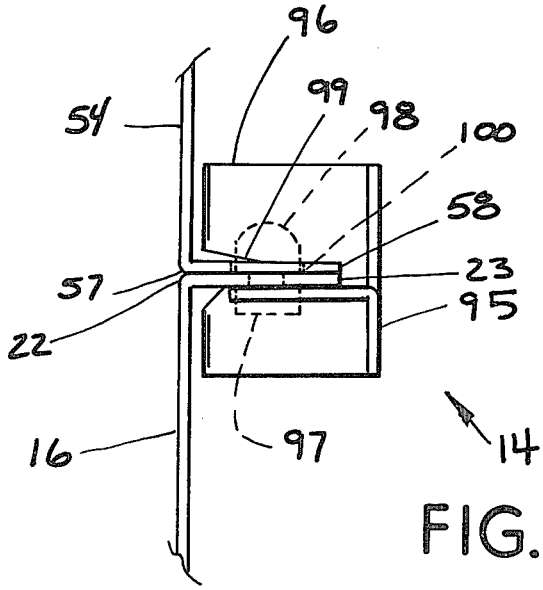
FIG. 14 is a detailed elevational view of the structure of FIG. 13 securing the structure of FIG. 1 together.

The front and rear fasteners 94, 95 are identical and are shown the detail in FIGS. 13 and 14 wherein the front fastener 95 of the base short side panel 16 is shown. The fastener 95 is a latch 96 rotatably journaled and fastened to the flange 23 by a fastener pin 97. The pin 97 has an upward extending portion forming a pilot pin 98. The latch 96 has a C-shaped cam slot 99. The top cap side panel flange 58 is the same size as the base side panel top flange 23, and has a pilot aperture 100. The flange 58 abuts down against and is supported by the flange 23. The pilot aperture 100 registers with and fits about the pilot pin 98 and positionally fixes the flange 58 to the flange 23 which positively positions the top cap 13 on the base 11. The latch 96 is turned in and the cam slot 99 clamps the flanges 23, 58 together as shown in FIG. 14. All of the fasteners 94, 95 are so structured, and as they are located one each adjacent a respective corner of the cabinet 10, the top cap 13 is secured at its four corners to the base 11.

The specific latch 96 used for fasteners 14 is more fully described in my co-pending application, U.S. Ser. No. 895,095, filed on Apr. 10, 1978.

The distal corner 67 of the top cap rear panel 64 is also positively positioned to the base 11. The cap rear panel flange 65 has a pilot aperture 101 in the distal corner 67, and the base rear panel top flange 25 has an upward extending pilot pin 102 which registers with and fits within the aperture 101 and positively positions the distal corner 67 for and aft on the base 11.

The cabinet top cap 13 is a self-supporting structure when it is removed from the base 11. The center of gravity of the top cap 13 is to the rear of an imaginary line drawn from the distal corner 67 to the lower front corner 103 of the top cap 13, and the top cap 13 when set upon a floor or table, is stable resting upon the side panel flange 58 and the rear panel flange 65.

The complete beverage dispensing machine 200 is shown in FIGS. 2 and 3. The top cap 13 is secured to the base 11 and the door 12 is closed. The fasteners 14 are not accessible and the cabinet 10 is as tamper-resistant as a one-piece cabinet box. The door 12 carries and presents a dispensing station 201, coin slot 202 and beverage vend selection panel 203 and the door lock 46. The top cap face plate 68 is above the door 12 and the cup tube open ends 77, 83 are presented for access.

Figure 5:
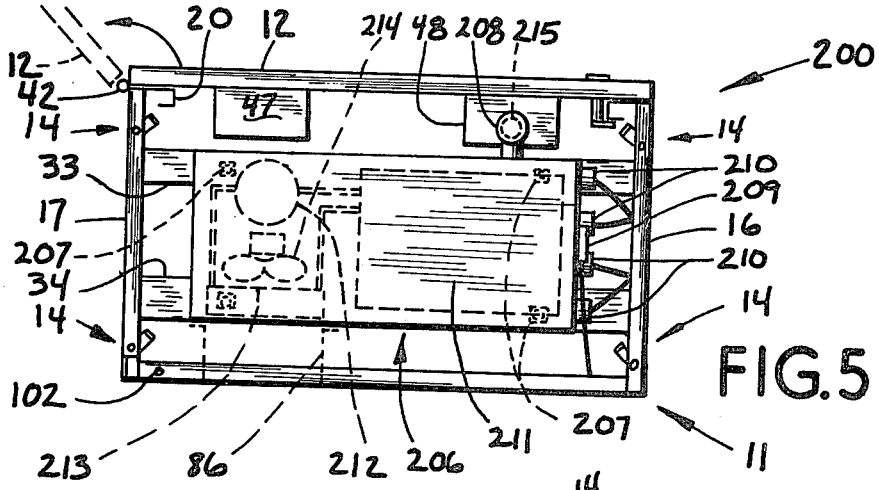
FIG. 5 is a top plan view of the machine of FIG. 2 with the top cap removed.
Figure 4:
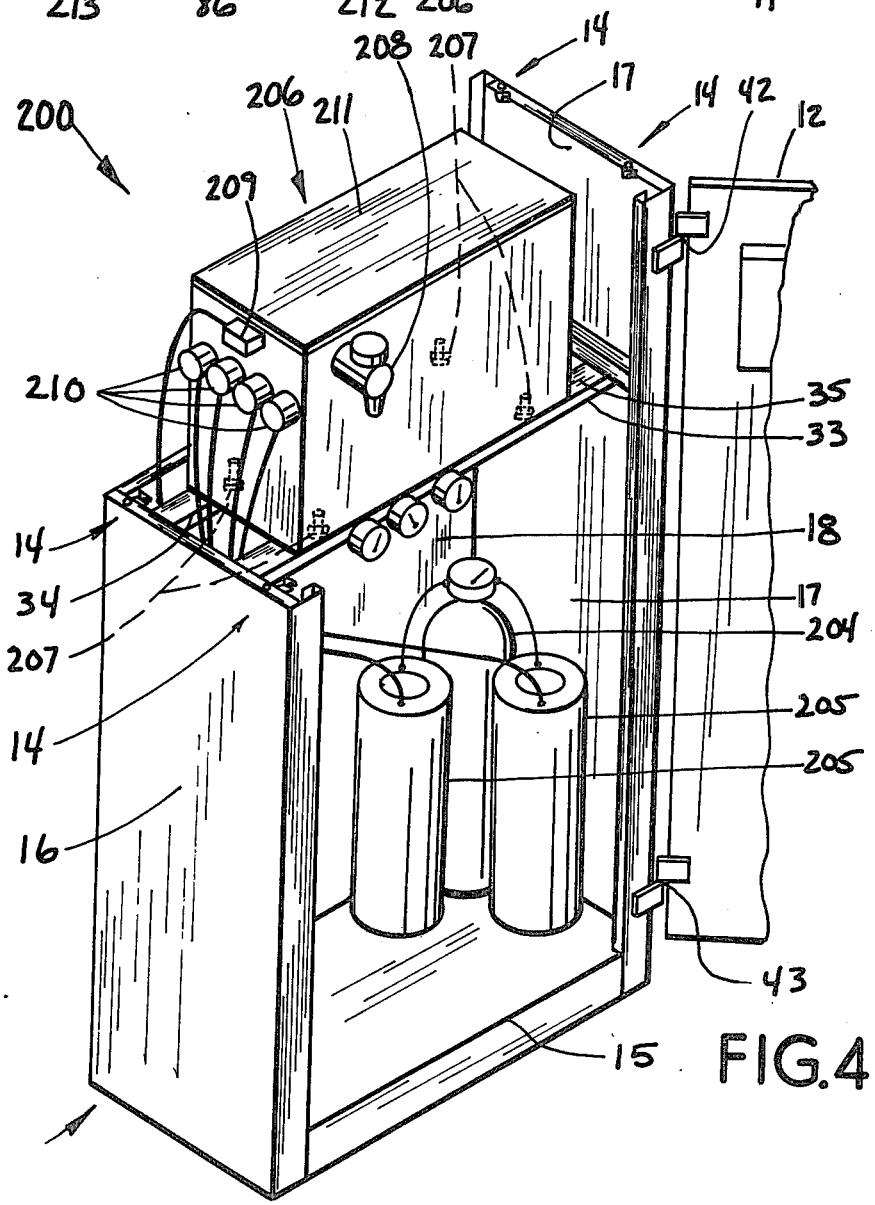
FIG. 4 is a perspective view of the machine of FIG. 2 with the cabinet door opened and the top cap removed.
Figure 9:
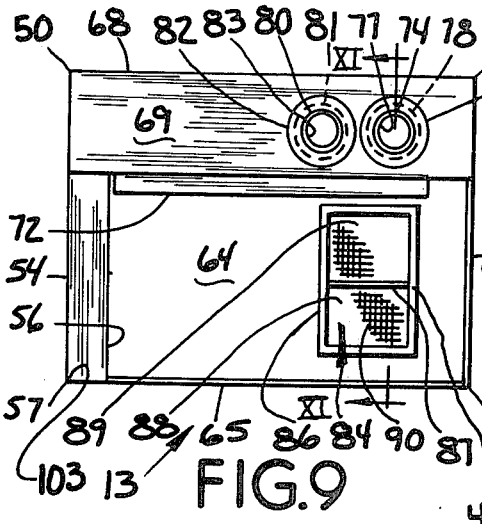
FIG. 9 is a front elevational view of the cabinet top cap in the structure of FIG. 1.
Figure 10:
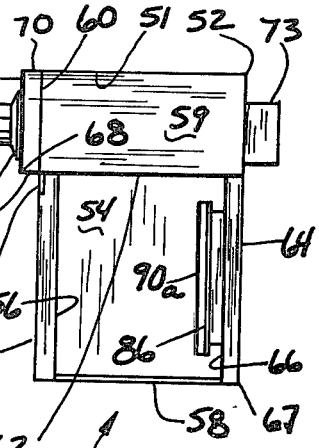
FIG. 10 is a side elevational view of the top cap of FIG. 9.
Figure 11:
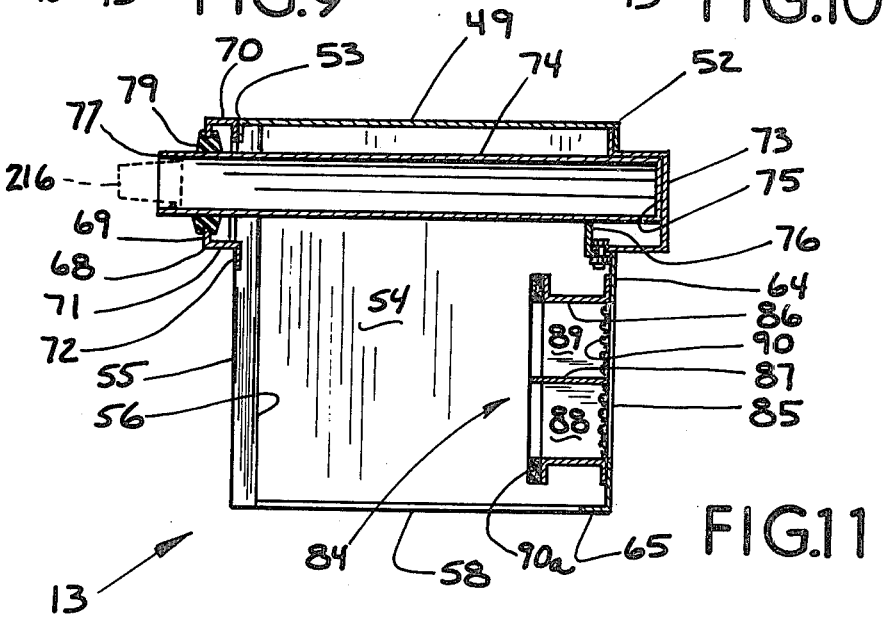
FIG. 11 is a side elevational section view taken through section lines XI—XI of FIG. 9.
Figure 12:
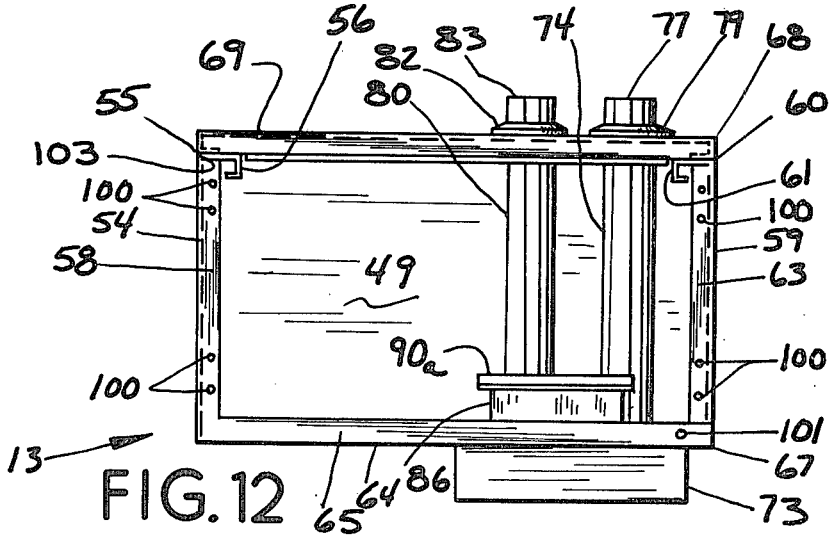
FIG. 12 is a plan view looking up from the bottom at the cabinet top cap of FIG. 9.

The interior components of the beverage dispensing machine are shown in FIGS. 4, 5 and 6 wherein the top cap 13 is removed. A carbon dioxide vessel 204 and syrup vessels 205 are stored in the base storage compartment 40. A beverage dispensing apparatus 206 is mounted to the structural cross member 32 on the support surface 35 and is secured by fasteners 207 through apertures 36. The dispensing apparatus 206 includes a dispensing nozzle 208 for mixing water and beverage concentrate, an electrical service 209, electic solenoid valves 210 for beverage ingredients and carbon dioxide, and a removable top cover 211. Inside of the apparatus there is a refrigeration system including a compressor 212, condenser 213 and condenser fan 214. The condenser 213, seen from the rear in FIG. 6, registers with the air passageway 84 of the top cap 13 and the fan 214 both draws in and expels air through the passageway 84. The dispensing nozzle 208 registers with an aperture 215 through which beverage passes into the dispensing station 201.

The present invention has many advantages for the fabrication, assembly, use and servicing of a beverage dispensing machine.

The base 11 is assembled by welding the side panels 16, 17 and rear panel 18 to the bottom 15 and to each other. The structural cross-member 32 is then welded to the side panels 16, 17 which rigidifies and fixes the distance between the side panels 16, 17. The base 11 may be supported by the cross member 32 when run through a continuous conveyor paint facility. The tall side panel 17 provides the normal wide apart hinge joint structure for support of a full height front door 12 but yet the remainder of the cabinet 10 is short and the cantilevered part **17*a* of tall side panel 17** is structurally sufficient to stand by itself.

The door 12 is fabricated by itself and is a complete assembly for later assembly to the base 11. The cabinet top cap 13 is welded together and painted as a complete and distinct structure.

For assembly of the beverage dispenser 200, the base 11 is brought to an assembly line. The top cap fasteners 14 are installed and the dispensing apparatus 206 which was previously assembled and tested is secured to the cross member 32. The door 12 is lowered into position on the hinges 41, the cup tubes 74, 80 are mounted in the top cap 13 and the top cap 13 is then lowered upon the base 11 and the fasteners 14 are secured.

In use of the beverage dispenser 200, the door 12 is unlocked and opened. Carbon dioxide and beverage syrup vessels 204, 205 are placed in the storage compartment 40 and hooked up. The cup tubes 74, 80 are loaded with cups 216. A customer for a beverage withdraws a cup and places the cup in the beverage dispensing station 201 and under the nozzle 208. The customer then presses a button for the desired selection and the dispensing apparatus 206 fills the cup.

In the event of malfunction or failure in the beverage dispensing machine 200, the service man opens the door 12, releases the top cap fasteners 14, and removes the top cap 13 and places it upon a floor or table where it stablely rests. The dispensing apparatus 206 which is entirely above the side panels 16, 17 is then directly accessible from the front, one side, the rear and the top. The solenoid beverage valves 210 which are on the dispensing apparatus 206 and which were facing the top cap tall side panel 54 are now directly accessible. The door 12 may be closed and operation of the machine 200 observed from the rear of the door 12. Faulty components may be diagnosed quickly and replaced easily. In the event of refrigeration system failure, the entire dispensing apparatus 206 may be removed and quickly replaced by a like module. The dispensing apparatus 206 can also be removed and replaced by a different type of module, either of improved type or of a type for different beverages. The entire dispensing apparatus 206 is unobstructably accessible for cleaning and the base 11 effectively functions as a workbench for the dispensing apparatus 206.

In the event of cabinet damage, the door 12, top cap 13, or base 11 and each be replaced independently of the other. The cup tubes 74, 80 are enclosed and are above the level of the dispensing station 201 and are isolated from contamination. The top cap 13 is swiftly removable and tools are not needed for such removal. The beverage dispensing machine 200 is a substantial improvement offering cleanliness, serviceability and most efficient use of materials for its construction while offering the structural integrity of a one-piece construction.

Although other advantages may be found and realized and various and minor modifications may be suggested by those versed in the art, be it understood that I wish to embody within the scope of the patent warranted hereon, all such improvements as reasonably and properly come within the scope of my contribution to the art.

I claim as my invention:

1. A beverage dispensing machine cabinet, comprising:

a. a cabinet base having
   (1) a bottom,
   (2) a short side panel attached to the bottom,
   (3) a rear panel attached to the bottom and the short side panel,
   (4) a tall side panel attached to the bottom and the rear panel, said tall side panel being of greater height than said short side panel, and
   (5) a hinge for a cabinet door, said hinge being mounted to one of said side panels;

b. a cabinet door pivotally mounted to said base by said hinge;

c. a removable cabinet top having
   (1) a top panel with first and second side edges,
   (2) a side panel connected to the top panel first side edge,
   (3) means on said top cap side panel for normal securement of the top cap side panel to the base short side panel, and
   (4) means on the top panel second edge for normal securement of the top panel second edge to the base tall side panel; and d. fastener means securing said top cap to said base, said fastener means being inoperably renderable for releasing the top cap from the base.

2. A beverage dispensing machine cabinet according to claim 1, in which the hinge is mounted to the base tall side panel, and in which the hinge extends on the tall side panel to a level higher than the highest level of the base short side panel.

3. A beverage dispensing machine cabinet according to claim 2, in which the cabinet door extends to a level higher than the highest level of the base short side panel.

4. A beverage dispensing machine cabinet according to claim 3, in which the cabinet door and the base tall side panel are of substantially the same height.

5. A beverage dispensing machine cabinet according to claim 2, in which the base tall side panel has a front edge having a structural stiffener extending therealong, and in which the hinge is mounted to said stiffener.

6. A beverage dispensing machine cabinet according to claim 5, in which the stiffener is continuous through the effective length of the hinge and in which the base includes a structural cross member fastening the base tall and short side panels to each other at substantially the highest level of the base short side panel, said hinge being at a level both above and below the structural cross member.

7. A beverage dispensing machine cabinet according to either of claims 5 or 6, in which the base tall side panel has a rear edge having a structural element extending therealong.

8. A beverage dispensing machine cabinet according to any of claims 2, 5 or 6, in which an upper portion of the base tall side panel extending above the level of the base short side panel is of a cantilever configuration.

9. A beverage dispensing machine cabinet according to any of claims 2, 5 or 6, in which the hinge comprises an individual bottom hinge element and an individual top hinge element, said hinge elements being spaced from each other with the bottom hinge element being adjacent to the base bottom, and the top hinge element being at a level above the highest level of the base short side panel.

10. A beverage dispensing machine cabinet according to claim 1, in which the base includes a structural cross member spaced above and extending across the base said cross member fastening the base short and tall side panels to each other.

11. A beverage dispensing machine cabinet according to claim 10, in which the structural cross member is substantially at the level of the highest level of the short side panel.

12. A beverage dispensing machine cabinet according to either of claims 10 or 11, including a pair of such structural members, said members being spaced from one another and being one behind the other.

13. A beverage dispensing machine cabinet according to claim 10, in which the base short side panel has a top structural flange extending from the rear to the front of itself, and in which the tall side panel has a structural flange extending from the rear to the front of itself at substantially the same level as the short side panel top flange, with said structural cross member being fastened to said base side panel immediately adjacent to the respective flanges.

14. A beverage dispensing machine cabinet according to claim 13, in which the base tall side panel has a top flange substantially the equivalent of the base short side panel top flange.

15. A beverage dispensing machine cabinet according to any of claims 10, 13 or 14, in which the base rear panel includes a structural top flange extending across the rear panel between the base side panels and at substantially the same level as the structural cross member.

16. A beverage dispensing machine cabinet according to claim 1, in which each of the base tall and short side panels have a substantially horizontal top flange extending inwardly into the cabinet and from the front to the rear of each respective panel.

17. A beverage dispensing machine cabinet according to claim 16, in which the fastener means are mounted to the base side panel top flanges.

18. A beverage dispensing machine cabinet according to claim 17, in which there are two such fastener means on each top flange, one being on the rear of each respective top flange and one being on the front of each respective top flange.

19. A beverage dispensing machine cabinet according to any of claims 16, 17 or 18 in which said fastener means each comprise a latch rotatably journaled to a respective flange, and means forming a pilot for positioning the top cap upon the base.

20. A beverage dispensing machine cabinet according to claim 16, in which the top cap side panel has a lower edge flange extending inwardly and abutted against the top flange of the base short side panel, and in which the top cap second edge has attached thereto an inwardly extending flange abutted against the top flange of the base tall side panel.

21. A beverage dispensing machine cabinet according to claim 20, in which the fastening means include clamp means for clamping each pair of abutting flanges together.

22. A beverage dispensing machine cabinet according to claim 21, including means for positively positioning the abutting flanges with respect to each other.

23. A beverage dispensing machine cabinet according to claim 22, in which the positioning means comprise apertures in the top cap flanges which are registrable with pilot pins in the base side panel flanges.

24. A beverage dispensing machine cabinet according to claim 1, in which the top cap includes a rectangular rear panel connected to the cap top panel and the cap side panel, said cap rear panel having a distal lower corner atop of the base rear panel and adjacent to the base tall side panel, and in which the base and top cap jointly include means for positively positioning the distal corner with respect to the base.

25. A beverage dispensing machine cabinet according to claim 1, in which top cap includes a rectangular rear panel connected to the cap top panel and the cap side panel, said cap rear panel having a distal lower corner atop of the base rear panel and adjacent to the base tall side panel, and in which the center of gravity of the top cap is to the rear of an imaginary straight diagonal line extending from the distal corner to a lower front corner of the cap side panel, said top cap being stablely restable upon lower edges of the cap side panel and cap rear panel when the top cap is removed from the base and placed upon a flat horizontal surface.

26. A beverage dispensing machine cabinet according to claim 1, in which the base includes a structural cross member extending across the base and fastening the base short side panel to the base tall side panel, said cross member being spaced forward of the base rear panel and rearward of the cabinet door, and in which said top cap fastener means include a pair of individual fasteners securing the top cap side panel to the base short side panel with one of the pair being between the cross member and the rear panel and a second of the pair being between the cross member and the cabinet door.

27. A beverage dispensing machine cabinet comprising:

a. a cabinet base having
   (1) a bottom,
   (2) a short side panel attached to the bottom,
   (3) a rear panel attached to the bottom and the side panel,
   (4) a tall side panel attached to the bottom and the rear panel, said tall side panel being of a greater height than said short side panel, and
   (5) a hinge for a cabinet door, said hinge being mounted to a front edge of said tall side panel;

b. A cabinet door pivotally mounted to said base tall side panel by said hinge;

c. a removable cabinet top cap having:
   (1) a top panel,
   (2) a short side panel connected to the top panel, and
   (3) a tall side panel connected to the top panel and being of greater height than said cap short side panel; and d. means for mounting said top cap on and to said base with said top cap short side panel being atop said base tall side panel and jointly forming a first complete side of the cabinet, and with said top cap tall side panel being atop of said base short side panel and jointly forming a second complete side of the cabinet.

28. A beverage dispensing machine cabinet according to claim 27, in which said first and second cabinet sides are of substantially the same height and in which said top panel and bottom are substantially parallel to one another.

29. A beverage dispensing machine cabinet according to claim 28, in which said base rear panel is of substantially the same height as one of said base side panels, and in which said top cap includes a rear panel of substantially the same height as one of the cap side panels, with said top cap rear panel being mountable on and to said base rear panel and forming therewith a complete rear side of the cabinet of substantially the same height as the cabinet sides.

30. A beverage dispensing machine cabinet according to claim 29, in which the base rear panel height is substantially to the height of the base short side panel and in which the top cap rear panel height is substantially equal to the height of the cap tall side panel.

31. A beverage dispensing machine cabinet according to claim 30, in which said cap rear panel has a distal lower corner, said corner having means for being piloted to said base.

32. A beverage dispensing machine cabinet according to claim 27, in which said top cap has a face plate extending across the front of the cap and fastened to each of the cap side panels.

33. A beverage dispensing machine cabinet according to claim 32, in which the face plate and top cap short side panel are of substantially the same height as measured downwardly from the top panel.

34. A beverage dispensing machine cabinet according to either of claims 32 or 33, including a cup storage and dispenser tube at least partially supported by said face plate.

35. A beverage dispensing machine cabinet according to claim 32, including a cup storage and dispenser tube mounted within the top cap and having an open end extending externally of the top cap through an aperture in the face plate.

36. A beverage dispensing machine cabinet according to claim 35, in which said cup tube is mounted substantially parallel to said cap top panel.

37. A beverage dispensing machine cabinet according to either of claims 35 or 36, including a non-metallic grommet mounted in the face plate aperture and spacing the cup tube from the aperture.

38. A beverage dispensing machine cabinet according to either of claims 35 or 36, including a plurality of such cup tubes, said tubes being parallel to one another and extending externally of the top cap through an aperture provided for each respective tube.

39. A beverage dispensing machine cabinet according to claim 35, in which said top cap includes a hollow stand-off projecting outwardly to the rear of the cap rear panel, said cup tube having a closed end mounted within the hollow stand-off.

40. A beverage dispensing machine cabinet according to claim 39, including means for securing the cup tube in the hollow stand-off.

41. A beverage dispensing machine cabinet according to claim 39, in which said stand-off extends only partially across the rear of the cap and in which the top cap includes an air passageway through the cap rear panel and directly below the stand-off.

42. A beverage dispensing machine cabinet according to claim 41, in which said air passageway is baffled and includes both an air inlet and an air outlet below the stand-off.

43. A beverage dispensing machine cabinet base, comprising a. a bottom, b. a short side panel attached to the bottom, c. a rear panel attached to the bottom and the short side panel, said rear panel being substantially the same height as the short side panel, d. a tall side panel attached to the bottom and the rear panel, said tall side panel being of a substantially greater height then either of said short side or rear panel, e. a hinge for supporting a cabinet door, said hinge being mounted to a front upright edge of said tall side panel, part of said hinge being above the level of the top of either of the short side or rear panels, f. a cross member spanning across the base substantially at the level of the top of the short side and rear panels, g. means for supporting a beverage dispenser apparatus at a level wherein the apparatus is substantially higher than the top of either said short side or rear panel, and h. means for supporting an enclosing top cap upon the side panels.

44. A beverage dispensing machine, comprising a. an upright cabinet base having
   (1) a bottom,
   (2) a pair of side panels attached one each to opposite sides of the bottom,
   (3) a rear panel attached to the bottom and the side panels, (4) a hinge for a cabinet door, said hinge being mounted on a front edge on one of said side panels, and (5) means for structurally supporting a beverage dispensing apparatus at a level higher than the highest level of one of the side panels;

b. beverage dispensing apparatus mounted on the base and to the structural supporting means, said apparatus including means for preparing and for dispensing a beverage, said apparatus being positioned at a level above the highest level of one of said panels;

c. a cabinet door pivotally mounted to said base by said hinge said door normally closing the front side of said base;

d. a removable cabinet top cap mounted upon said cabinet base and having (1) a top panel forming a top of the dispensing machine, (2) one side panel extending down past the dispensing apparatus to join with the said one of said base side panels, and said one top cap side panel and said one base side panel together forming a complete side of the dispensing machine, (3) lower peripheral edges fitted against upper edges of the base side and rear panels and a front edge fitted against the cabinet door, said top cap, base and door together jointly forming a complete cabinet enclosing said dispensing apparatus; and e. fastener means within the cabinet securing the top cap to the base, said fastener means being accessible from within the cabinet when the door is open and being thereupon inoperably renderable for releasing the top cap from the base; said top cap when released by said fastener means being removable from the dispensing machine thereby providing access to the dispensing apparatus from above, from the front and from a side.

45. A beverage dispensing machine according to claim 44, in which said one base side panel is a short side panel, the other side panel being a tall side panel of greater height than the short side panel and the door hinge being on the tall side panel, and in which the cabinet door is taller than the short side panel.

46. A beverage dispensing machine according to either of claims 44 or 45, in which the top cap includes a. a second side panel extending down and joining with the other of said base side panels; and b. a face plate extending across the front of the top cap and connected to both of the top cap side panels, said face plate and door together forming the front of the beverage dispensing machine.

47. A beverage dispensing machine according to claim 46, including a cup storage and dispenser tube mounted within the top cap and having an open end extending externally of the top cap through an aperture in the face plate.

48. A beverage dispensing machine according to either of claims 44 or 45, in which the top cap includes a. a rear panel extending down from the top panel; and b. an air passageway in the rear panel and registered with means in the dispensing apparatus for transferring heat from the beverage apparatus to ambient air.

49. A beverage dispensing machine according to either of claims 44 or 45, in which said dispensing apparatus is supported above the highest level of the said one base side panel.

50. A beverage dispensing machine according to either of claims 44 or 45, in which the base rear panel is of substantially the same height as the said one of said base side panels, and in which the top cap includes a rear panel extending down from the top panel.

51. A beverage dispensing machine according to either of claims 44 or 45, in which the dispensing apparatus is a module including means for thermally treating beverage ingredients and a dispensing head, said module being removably fastened to said structural supporting means and being removable and replaceable as a unit from the cabinet base when the top cap is removed.

52. A beverage dispensing machine according to either of claims 44 or 45, including electric beverage fluid solenoid valves mounted to the beverage dispenser apparatus and facing toward the said one top cap side panel.

53. A beverage dispensing machine cabinet base, comprising a. a bottom, b. a short side panel attached to the bottom, c. a rear panel attached to the bottom and the short side panel, d. a tall side panel being of a greater height than said short side panel, e. a hinge for supporting a cabinet door, said hinge being mounted to a front edge of said tall side panel, f. means for supporting a beverage dispenser apparatus at a level wherein the apparatus is substantially higher than the top of said short side panel, said means comprising a cross member spanning across the base substantially at the level of the top of the short side frame, said cross member being fastened to both of said side panels, and g. means for supporting an enclosing top cap upon the side panels.

54. A beverage dispensing machine cabinet base according to claim 60, in which the tall side panel has thereon a fore/aft structural flange at substantially the same level as the cross member.

55. A beverage dispensing machine cabinet base, comprising a. a bottom, b. a short side panel attached to one side of the bottom, c. a rear panel attached to the rear of the bottom and the short side panel, said rear panel being substantially of the same height as the short side panel, d. a tall side panel attached to a second and opposite side of the bottom and to the rear panel, said tall side being cantilevered above the level of the tops of the short side and rear panels, e. a hinge for supporting a cabinet door, said hinge being mounted to a front edge of said tall side panel and having a top hinge element mounted at a level substantially higher than either of the tops of the short side and rear panels, f. a cross member spanning across the base substantially at the level of the top of the short side frame, said cross member being fastened to and structurally interconnecting both of said side panels, g. means for supporting a beverage dispenser apparatus at a level wherein the apparatus is substantially higher than the tops of said short side and rear panels, and h. means for supporting an enclosing top cap upon the side panels.

* * * * *